United States Patent [19]

Kain

[11] Patent Number: 4,551,079

[45] Date of Patent: Nov. 5, 1985

[54] ROTARY VANE PUMP WITH TWO AXIALLY SPACED SETS OF VANES

[75] Inventor: Alexander S. Kain, Minety, England

[73] Assignee: Plenty Limited, England

[21] Appl. No.: 611,003

[22] PCT Filed: Sep. 28, 1983

[86] PCT No.: PCT/GB83/00243

§ 371 Date: May 15, 1984

§ 102(e) Date: May 15, 1984

[87] PCT Pub. No.: WO84/01408

PCT Pub. Date: Apr. 12, 1984

[30] Foreign Application Priority Data

Sep. 28, 1982 [GB] United Kingdom ..... 8227630

[51] Int. Cl.[4] ..... F04C 11/00; F04C 15/04

[52] U.S. Cl. ..... 418/26; 418/31; 418/173; 418/212

[58] Field of Search ..... 418/26, 31, 173, 212, 418/210, 213

[56] References Cited

U.S. PATENT DOCUMENTS

| | | | |
|---|---|---|---|
| 1,607,383 | 11/1926 | Aurand | 418/212 |
| 1,719,134 | 7/1929 | Roessler | 418/212 |
| 1,780,217 | 11/1930 | Wiltse | 418/210 |
| 2,720,171 | 10/1955 | Harrington et al. | 418/212 |
| 3,065,706 | 11/1962 | Shoosmith | 418/31 |

FOREIGN PATENT DOCUMENTS

| | | | |
|---|---|---|---|
| 522971 | 4/1955 | Italy | 418/173 |

*Primary Examiner*—John J. Vrablik

*Attorney, Agent, or Firm*—Wood, Herron & Evans

[57] ABSTRACT

A sliding vane type rotary pump having two sets of radially slidable vanes and two rotors, each vane set cooperating with a rotor to form a separate pump section with plural chambers. Each pump section is longitudinally spaced one from the other on a pump shaft's axis interiorly of a common housing. A common pump outlet and a common pump inlet are positioned between the two pump sections to provide fluid inflow and fluid outflow. The inflow to and outflow from each pump section's vane/rotor defined chambers is generally parallel to the pump shaft's longitudinal axis, and is through the side face of the pump section defined by each set of chambers.

10 Claims, 7 Drawing Figures

ROTARY VANE PUMP WITH TWO AXIALLY SPACED SETS OF VANES

Figure 1:
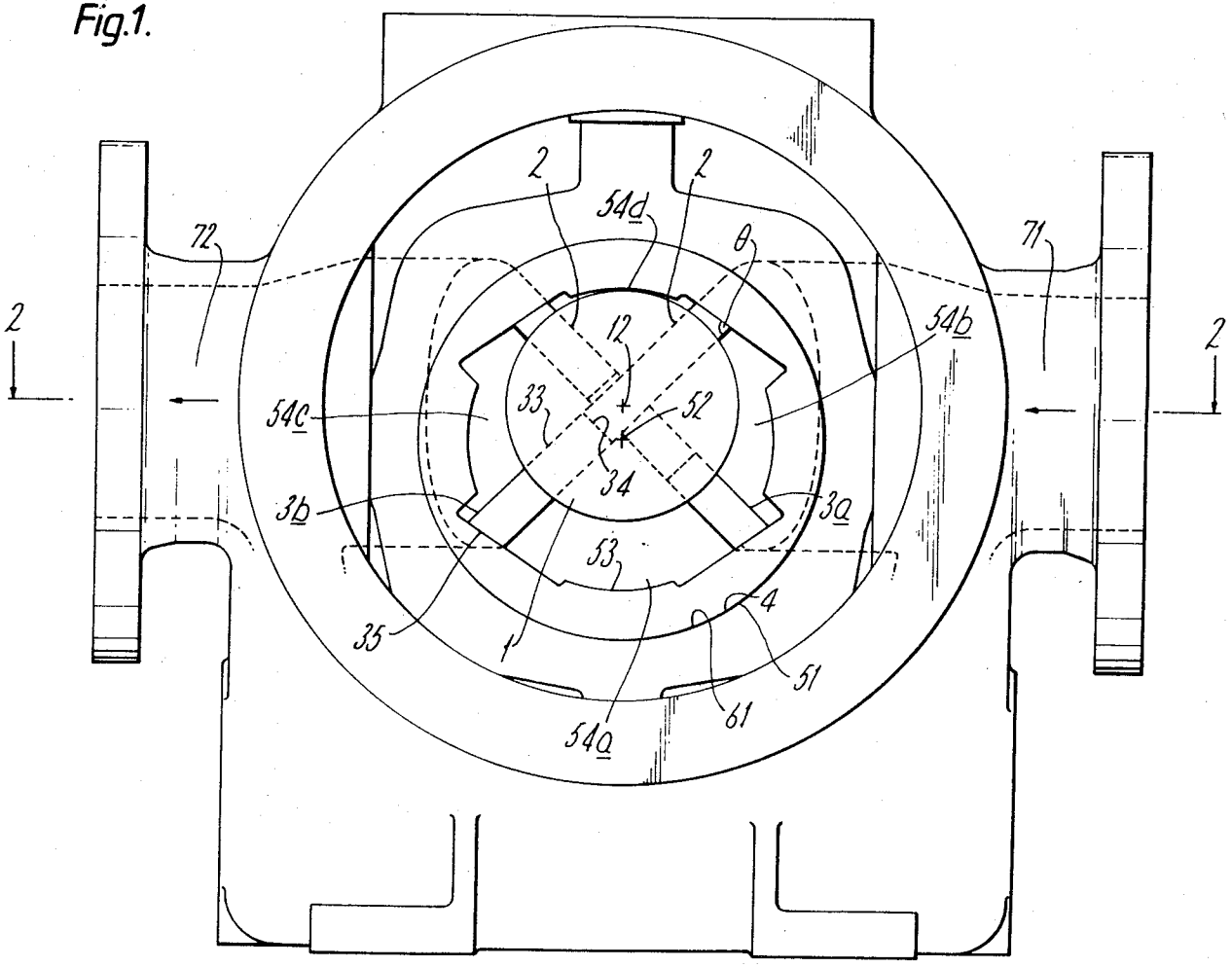

The present invention relates to rotary pumps of the sliding vane type.

Rotary pumps of the sliding vane type are well known and for example are shown in British Patent No. 834,925. These pumps comprise a rotory driven by a rotor shaft, the rotor shaft having four vanes slidingly mounted in slots in the shaft, the ends of the vanes being in bearing engagement with inwardly facing bearing surfaces provided on the rotor to form four pump chambers between the vanes and rotor. Rotation of the rotor shaft causes rotation of the rotor and fluid is conveyed by the rotating pump chambers from an inlet in the pump casing or stator to an outlet in the casing or stator. Such pumps may be variable in capacity by moving the axis of the rotor surrounded by a sliding cage relative the shaft and stator. The ends of the vanes where they bear on the rotor are often angled or chamfered relative to the tangent of the radial centre line of the vanes at an angle of about 15°. The rotor of the known pumps are radially ported so that as the rotor revolves in the stator a portion of the stator which can be on the sliding cage interacts with the ports to open or close the chambers.

Such pumps produce a pulsating output, each pulse corresponding in frequency to the rate of travel of each vane and subsequent vane past the outlet. In order to reduce the pulse frequency it is possible to increase the number of vanes. Unfortunately this results in a large rotor diameter since the rotor must have provision for each blade to slide in it.

A rotary vane pump according to the present invention comprises a rotor shaft, a rotor, a set of vanes slidably mounted to the rotor shaft at one axially longitudinal position on the rotor shaft, and a second set of vanes slidably mounted to the rotor shaft at a second axially longitudinal position on the rotor shaft, a stator surrounding the rotor, the first set of vanes and rotor forming a first pumping section and the second set of vanes forming a second pumping section where each pumping section feeds into a common pump outlet.

Preferably there are four vanes in each set, those of the first set being set at 45° to those of the second set. Preferably each set has its own rotor.

Advantages of the pump of the invention are that the outlet flow is smoother and therefore faster, the rotor can be also made smaller and thus a smaller pump may be provided for a given duty.

According to another aspect of the invention a rotary vane pump according to the present invention comprises a rotor and rotor shaft, at least one set of vanes slidably mounted to the shaft and a stator having a pump inlet with an axial feed from the inlet to rotary pump chambers formed between the vanes and the rotor.

Preferably a second set of vanes slidably mounted on the rotor shaft is provided, the second set being axially longitudinally spaced from the first set and wherein the feed from the inlet to the rotary pump chambers formed by each set of vanes is axial. The axial feed may be from the centre of the stator axially outwards.

Feeding the pump chambers axially eliminates the need for ports in the side of the rotor which in turn eliminates the acceleration and deacceleration of fluid in the inlet and outlet lines caused by the rotor ports. Thus removal of the need for ports combined with splitting the flow enables the pump to run faster and more quietly. Furthermore eliminating the rotor ports has the effect of increasing the area supporting the rotor which enables the pump to operate at higher discharge pressures.

Combining the increased output with an increased running speed enables the smaller pump to be offered for a given duty.

Preferably the vane ends terminate in a flat surface angled at about 80° to the vane sides. Hitherto this angle has been about 75°. The increase in angle that is the decrease in terminal slope enables the rotor bore to be increased and in turn the eccentricity between stator block or cage and rotor axes can be increased so as to further increase the pump output.

Figure 2:
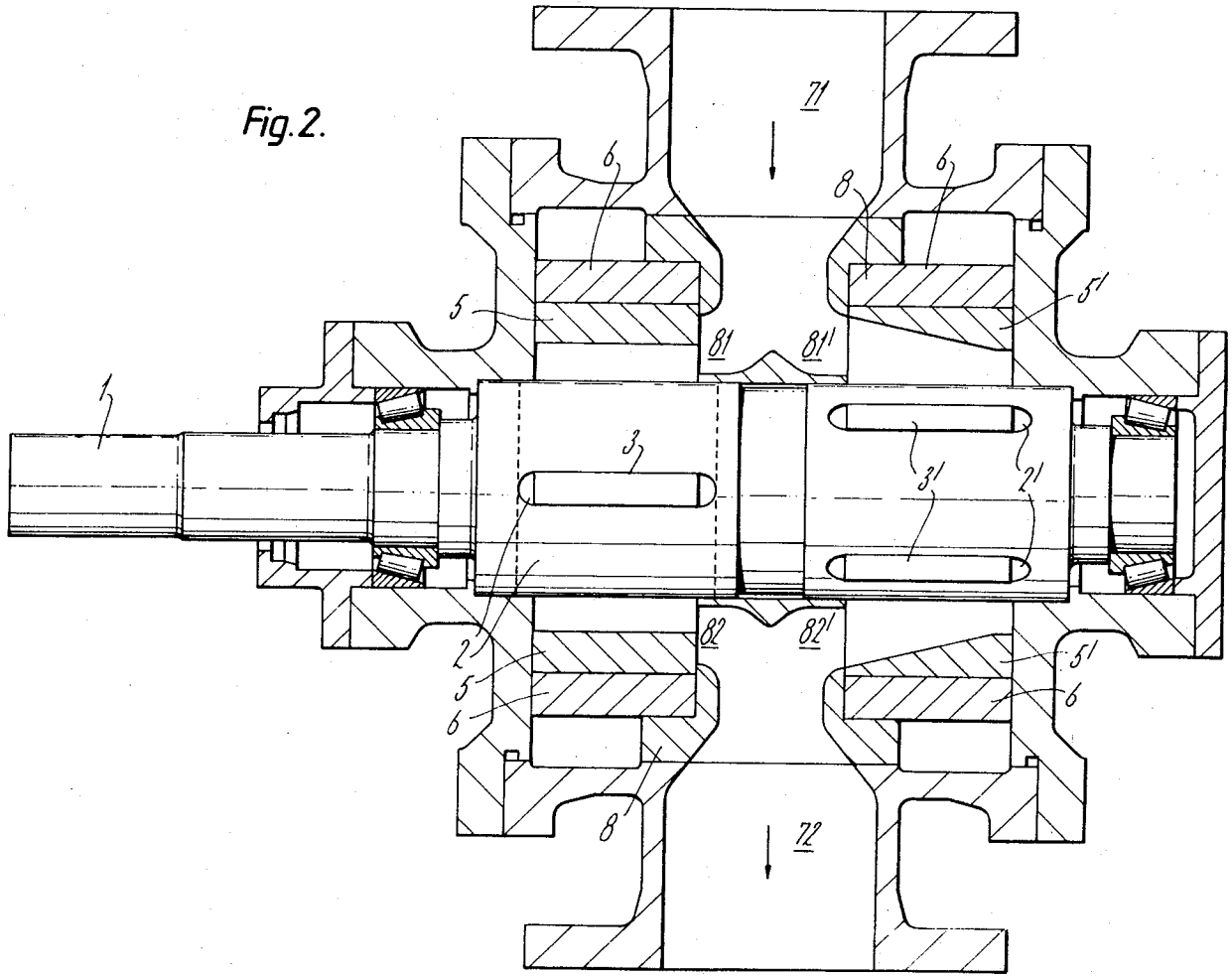
Figure 3:
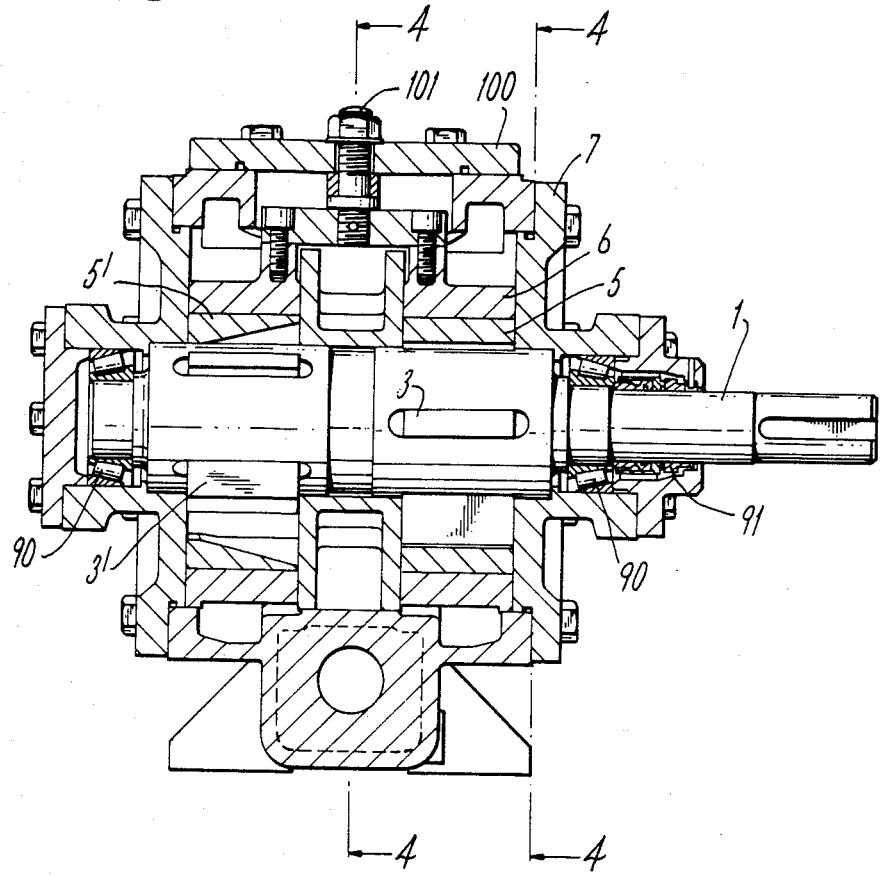
Figure 4:
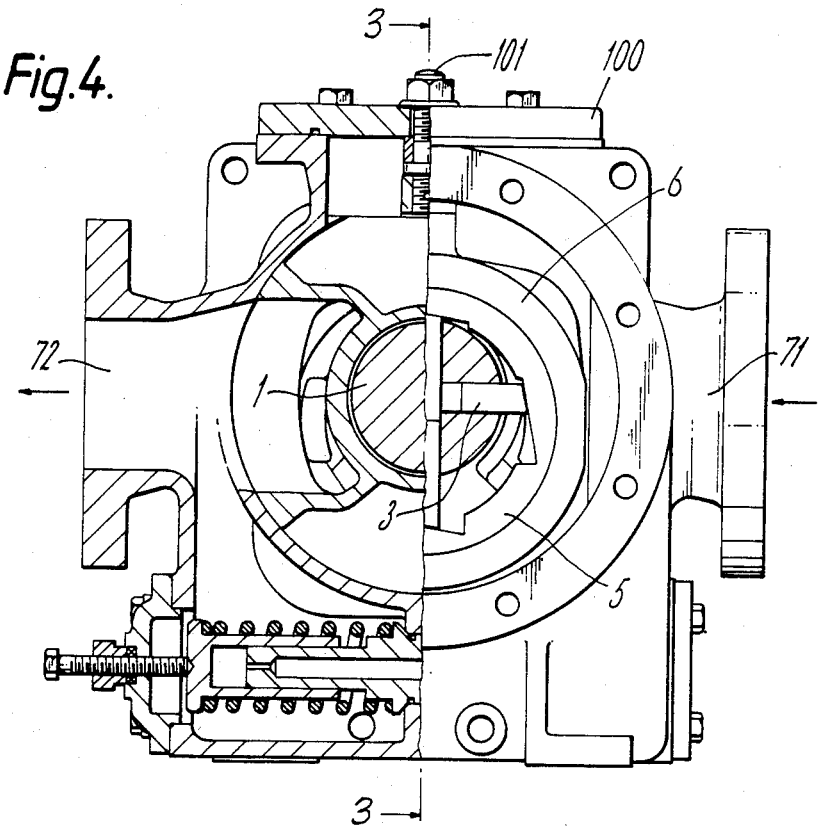
Figure 6:
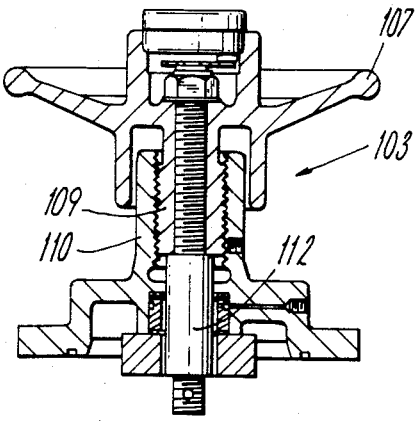
Figure 5:
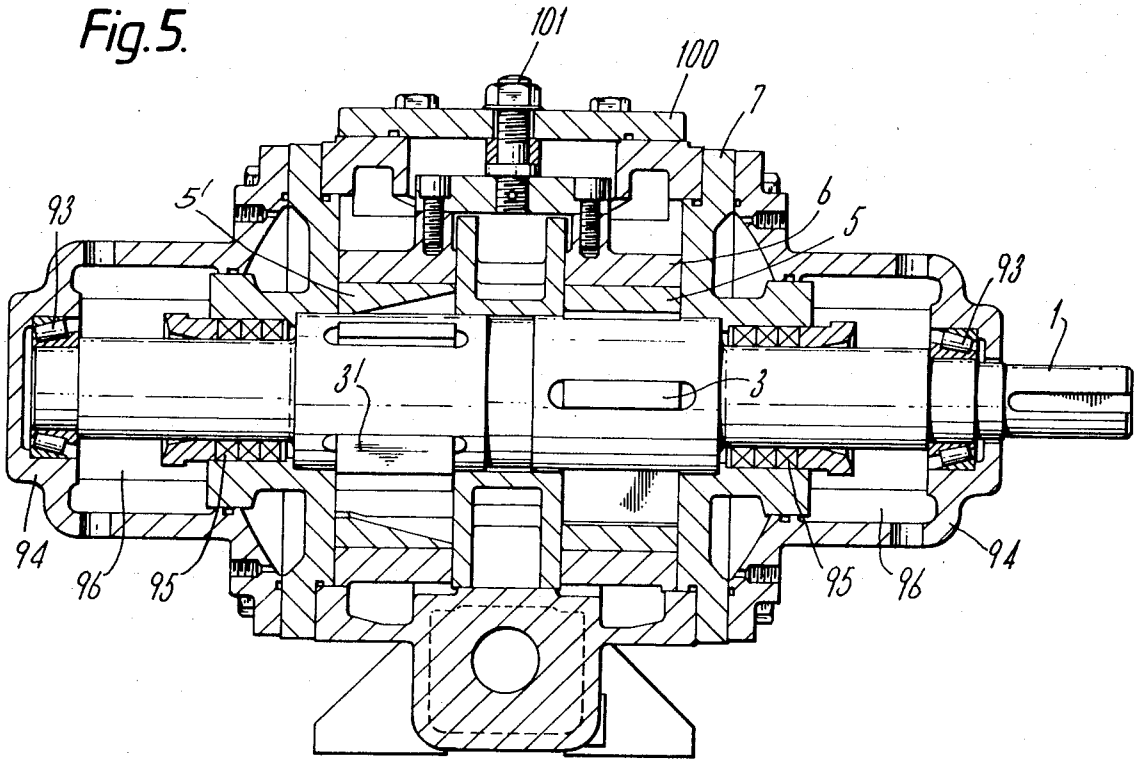

The invention will now be described by way of example with reference to the accompanying drawings in which:

FIG. 1 is a transverse vertical cross-section of a first embodiment of the invention being a universal rotary vane pump, FIG. 2 is an axial horizontal cross section of the first embodiment taken along line A—A of FIG. 1, FIG. 3 is an axial vertical cross section of a second embodiment of the invention being an inboard fixed flow pump section being taken along line A—A of FIG. 4, FIG. 4 is a transverse vertical cross section of the second embodiment being on the left a section along line B—B and on the right a section along line C—C of FIG. 3, FIG. 5 is an axial vertical cross section of a third embodiment of the invention being an outboard fixed flow pump the section being similar to that of FIG. 3, FIG. 6 is a vertical cross section of a hand control valve for varying the output of the pumps shown in FIGS. 3 to 5, FIG. 7 is a vertical cross section of a hydraulic control arrangement replacing the hand control valve of FIG. 6.

In FIGS. 1 and 2 may be seen a rotary shaft 1 provided with two transverse slots 2 at right angles to each other and forming a first set of slots, and two transverse slots 2' at right angles to each other forming a second set of slots. The second set of slots is axially aligned at 45° to the first set.

Each slot 2, 2' has a pair of vanes 3, 3' mounted therein. Each vane has parallel sides 33, a perpendicular inner end face 34 and an angled or chamfered outer end face 35 which is angled at 80° to the vane sides at $\theta$. That is to say is angled at 10° to the inner end face. The vanes freely slide in slots 2, 2'. The vanes may be both coupled in similar way to those shown in British Patent No. 1,013,801 or else one diametral pair may be coupled as shown at 3*a* in FIG. 1 and the other diametral pair may be uncoupled but in abutting relationship as shown at 3*b* in FIG. 1.

Figure 7:
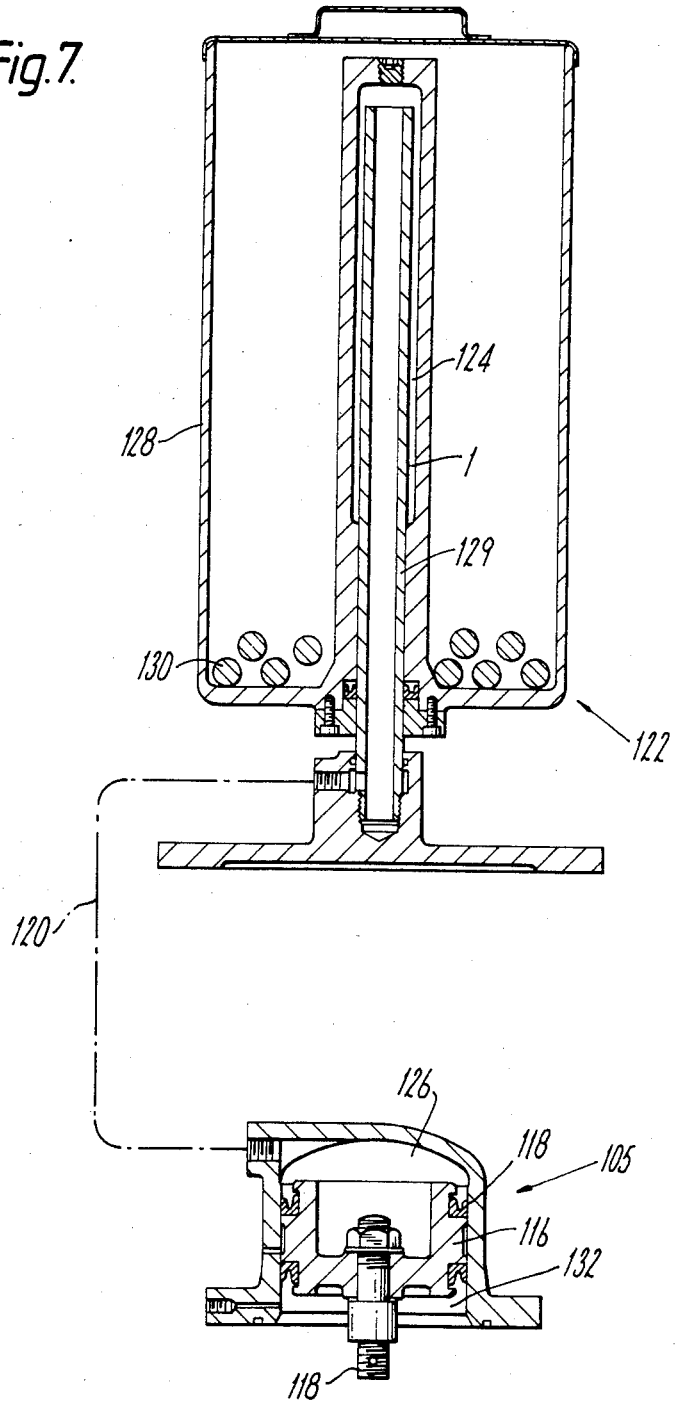

The outer end faces 35 abut on inner planer surfaces 4 of a rotor 5 the outer cylindrical surface 51 of which is carried rotatably by an inner corresponding surface 61 of a cage 6 which is either fixed in a stator 7 as shown in FIGS. 3 and 5 or else can be adjustable to vary the distance and thus the eccentricity between the rotor axis 52 and shaft axis 12. This adjusting may be either by a manual arrangement as shown in FIG. 6 or by a hydraulic arrangement as shown in FIG. 7. A similar axially spaced rotor 5' to rotor 5 is provided in stator 7 for the second set of vanes 3'.

Between each inner planar surface 4 of each rotor 5, 5' is curved surface 53. Chambers 54*a, b, c* are formed between the vanes and rotor 1 and a fourth chamber 54*d* is scarcely formed.

An inlet 71 and outlet 72 in stator 7 are provided which connect with the pump chambers 54*a*–d. The inlet and outlet diverge in a centre member 8 to provide two inlet ducts 81 and 81' and two outlet duct 82 and 82' which stream the inlet and outlet liquids axially into and out of the pump chambers. This eliminates the need for ports in the outer periphery of the rotors which reduces or eliminates the acceleration and deacceleration of the fluid in the suction and delivery lines caused by the rotor ports, thereby together with the split flow the pump may run faster and more quietly than known pumps. Also by eliminating the rotor ports this has the effect of increasing the area of the cage 6 supporting the rotors which enables the pump to operate at higher discharge pressures.

FIGS. 3 to 5 show in more detail two embodiments of the pump of the invention. The indexing of parts similar to those of FIGS. 1 and 2 is the same as in those figures. The inboard pump shown in FIG. 3 has roller bearings 90 which are lubricated by the medium being pumped. A seal 91 either mechanical or soft packing seals between the shaft 1 and stator 7. The outboard pump shown in FIG. 5 is designed to handle low lubricity liquids or liquids not compatible with roller bearings; in this pump shaft 1 is supported in roller bearings 93 which are external of the liquid being pumped and are grease lubricated. The bearings 93 are in turn supported in brackets 94. The stator 7 is sealed to shaft 1 by means of mechanical or soft packing seals 95. Brackets 94 also form heating or cooling chambers 96.

In FIGS. 3 to 5 a cover plate 100 is provided on the stator 7 when the pumps are used as fixed flow pumps. The cover plate has a centre stud 101 which locks the cage 6 to the stator. When it is desired to convert the pumps to variable flow pumps, cover plate 100 and stud 101 are removed and either the hand control generally shown at 103 in FIG. 6 or the hydraulic actuator generally shown at 105 in FIG. 7 are bolted to the stator.

In the hand control 103 a handwheel 107 has a threaded portion 109 which cooperates with a threaded sleeve 110 to move a pin 112 up or down. Pin 112 is connected to cage 6 so that the cage eccentricity can be varied.

In the hydraulic actuator 105 a piston 116 is secured to a pin 118 which is connected to cage 6 so that piston movement causes the cage eccentricity to be varied. Piston 116 works in cylinder 118 the upper part of which above the piston 116 is connected via line 120 to accumulator chamber 124 in accumulator 122. The space 126 above piston 116, line 12 and chamber 124 are filled with hydraulic oil. Weight is applied to weight container 128 in the form of steel pellets 130. The weight of the container 128 and pellets 130 pressurises the oil in line 120, the container 128 sliding up and down ram 129. Pump pressure is fed to space 132 under the piston. A slight change in pump discharge pressure causes piston 116 to move which in turn moves cage 6 thus adjusting the pump output until the system balances again.

I claim:

1. A sliding vane type rotary pump comprising two sets of vanes slidably mounted to a rotor shaft, said vane sets being located at spaced longitudinal positions along the shaft's axis, a rotor surrounding each of said vane sets, each rotor having flats on its inner surface contacted by the outer ends of the vanes associated therewith, said vanes of each set and said rotor shaft cooperating to define two sets of chambers located at spaced longitudinal positions along the shaft's axis, the inlets and outlets to one set of chambers being through one side face thereof, and the inlets and outlets to the other set of chambers being through the adjacent side face of said other set, so that the inlets and outlets of said two chamber sets face one another, a stator within which said rotors and rotor shaft are positioned, and a common pump inlet and a common pump outlet at least partially defined by said stator, said inlet and outlet being located between said longitudinally spaced chambers, the fluid inflow to and fluid outflow from said two chamber sets thereby being generally parallel to the shaft's axis as fluid passes through said pump from said common inlet to said common outlet.

2. A pump as set forth in claim 1, said inlet and outlet comprising a centre member surrounding said shaft that diverges to provide two inlet ducts and two outlet ducts, each duct being generally parallel to the shaft's axis, to direct the inlet and outlet fluid streams generally axially into and out of said pump chambers.

3. A pump as set forth in claim 1, the vanes of said first vane set being set, relative to the shaft's axis, at about 45° relative to those of said second vane set.

4. A pump as set forth in claim 1, the outer ends of each vane terminating in a flat surface angled at about 80° relative to that vane's side.

5. A pump as set forth in claim 1, said pump comprising a cage within which each rotor is mounted, said cages being adjustable radially relative to the shaft axis so as to vary the distance between the associated's rotor axis and the shaft's axis as desired.

6. A pump as set forth in claim 5, said pump comprising radial adjustment connected with at least one cage, said means being in the form of a hand-operable control cooperating with a threaded member.

7. A pump as set forth in claim 5, said pump comprising radial adjustment means connected with at least one cage, said means being in the form of a piston.

8. A pump as set forth in claim 7, said piston being mounted in a liquid filled cylinder connected by a conduit to an accumulator chamber in an accumulator.

9. A pump as set forth in claim 8, said liquid acting on one side of said piston, said pump's discharge being connected to the other side of said piston, the accumulator pressure being adjustable to vary the pressure acting on said one side of said piston.

10. A pump as set forth in claim 9, said accumulator comprising a hollow fixed shaft having its interior connected to said cylinder, and said accumulator chamber surrounding a part of said shaft, said chamber being formed in a part of a container that contains weight which can be adjusted to bias the pressure acting on said one side of said piston.

* * * * *